US011754369B1

(12) United States Patent
McCauley et al.

(10) Patent No.: US 11,754,369 B1
(45) Date of Patent: Sep. 12, 2023

(54) WEAPON LIGHT

(71) Applicants: Sean McCauley, Chandler, IN (US); Eric Small, Chandler, IN (US); David A. Winge, Chandler, IN (US); Matt Tenbarge, Chandler, IN (US)

(72) Inventors: Sean McCauley, Chandler, IN (US); Eric Small, Chandler, IN (US); David A. Winge, Chandler, IN (US); Matt Tenbarge, Chandler, IN (US)

( * ) Notice: Subject to any disclaimer, the term of this patent is extended or adjusted under 35 U.S.C. 154(b) by 388 days.

(21) Appl. No.: 17/168,263

(22) Filed: Feb. 5, 2021

Related U.S. Application Data

(60) Provisional application No. 62/970,914, filed on Feb. 6, 2020.

(51) Int. Cl.

| | |
|---|---|
| ***F41G 1/35*** | (2006.01) |
| ***F21L 4/00*** | (2006.01) |
| ***F41G 1/34*** | (2006.01) |
| ***F41G 11/00*** | (2006.01) |

(52) U.S. Cl.
CPC ..... *F41G 1/35* (2013.01); *F41G 1/345* (2013.01); *F41G 11/003* (2013.01)

(58) Field of Classification Search
USPC ..... 42/146
See application file for complete search history.

(56) References Cited

U.S. PATENT DOCUMENTS 5,091,611 A * 2/1992 Reeves ..... H01H 13/58 362/208
8,556,450 B2 * 10/2013 Grossman ..... H01M 10/46 362/202

* cited by examiner

*Primary Examiner* — Reginald S Tillman, Jr.
(74) *Attorney, Agent, or Firm* — Gary K. Price

(57) ABSTRACT

A weapon light including a head lamp portion, a tubular body portion and an end cap that is releasably coupled to the tubular body. A spacing is defined within the tubular body portion between a battery spring and an end portion. A first member of the end cap includes at least one slot for sliding receipt of at least one guide member of an insert. The tubular body is configured to threadably receive a spacer member that defines a central aperture such that the battery spring extends from the insert and passes through the central aperture into the tubular body portion to make contact with the power source. The spacer member is selectively positioned within the tubular body portion so that the insert may be urged along slot to position the battery spring inside the tubular body to adjust the spacing to fit the power source size.

10 Claims, 4 Drawing Sheets

WEAPON LIGHT

CROSS REFERENCES TO RELATED APPLICATIONS

U.S. Provisional Application for Patent No. 62/970,914, filed Feb. 6, 2020, with title "Weapon Light" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates generally to a weapon light that is particularly suited for being interfaced with all long firearms having for example, a MIL-STD 1913 accessory mounting rail. More specifically, the present invention relates to a better suited weapon light having advanced capabilities for receiving various size batteries (electrical power source) as is known in the art.

2. Brief Description of Prior Art

In the prior art, weapon lights or flashlights for use in firearm applications have typically been constructed in a standard fashion utilizing multiple components including a weapon light and a weapon light mount. Known weapon mounted lights generally include a tubular body portion configured to house the electrical power source (batteries) to power the weapon light assembly. Moreover, within the known tubular body portion there is a defined space between the battery spring disposed at one end of the tubular body portion, the battery spring configured to make conductive contact with the negative end of the battery, and an end portion of the light head assembly in contact with the battery's positive end.

As is also known in the prior art, batteries come in various sizes. As a result, certain sized batteries may correctly fit within the defined space in the tubular body portion and, certain sized batteries may for example be smaller than the defined space resulting in a space or gap between the battery ends and contact ends of the weapon light. As should be understood, any gap formed between the battery ends and contact ends may result in a poor electrical contact between the battery and electrical components of the weapon light.

In view of the foregoing disadvantages inherent in the prior art flashlights, there is a need for a weapon light device that is configured to adjust to various size batteries in order to maintain electrical contact between the battery ends and contact ends of the weapon light. It is with this need in mind that the present invention was developed.

SUMMARY OF THE INVENTION

A weapon light that generally includes a head lamp portion, a tubular body portion that is releasably coupled to the head lamp portion, and an end cap portion that is releasably coupled to the tubular body and opposite the head lamp portion. As will be described, the weapon light includes an innovative end cap portion and the inclusion of a spacer member threadably disposed within an end of the tubular body portion.

The end cap portion includes a first member that couples to the tubular body portion, an insert that includes the battery spring and at least one guide member and a wire that is connected to a prior art tape switch, and an end that is coupled to the first member. The first member includes at least one slot for sliding receipt of the at least one guide member of the insert. In application, the battery spring can be selectively positioned within the tubular body by positioning the at least one guide member along the at least one slot.

The end of the tubular body that couples to the end cap is further configured to threadably receive the spacer member. The spacer member defines a central aperture such that in application, the battery spring extends from the insert and passes through the central aperture, into the tubular body portion in contact with the battery.

The spacer member further includes an edge that in application may abut an edge of the insert that acting as a stop for positioning of the battery spring within the tubular body. More particularly, the space member is selectively positioned within the tubular body so that the insert may be urged towards the end of the slot until the edge of the insert contacts the stop of the guide member thereby positioning the battery spring more or less inside the tubular body to adjust the defined space within the tubular body portion to appropriately fit the size batteries.

DESCRIPTION OF THE PREFERRED EMBODIMENT

Figure 1:
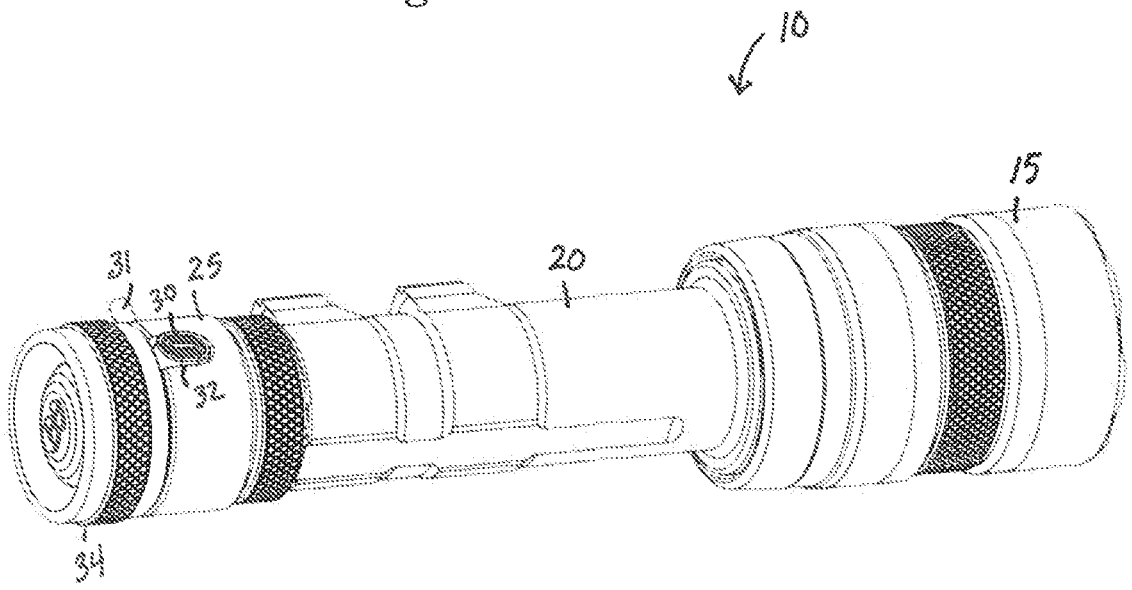
FIG. 1 is a perspective view of a preferred embodiment of the present invention, a rail mounted weapon light.

The present invention specifically addresses and alleviates the above mentioned deficiencies associated with the prior art. More particularly, the present invention discloses a weapon light that is configured to adjust the size of its battery compartment to fit various size batteries and maintain electrical contact between the battery ends and contact ends of the weapon light. In the broadest context, the weapon light of the present invention consists of components configured and correlated with respect to each other so as to attain the desired objective.

As illustrated, the weapon light 10 generally comprises a head lamp portion 15, a tubular body portion 20 that is releasably coupled to the head lamp portion 15, and an end cap portion 25 that is releasably coupled to the tubular body 20 and opposite the head lamp portion 15, the tubular body portion 20 therefore being disposed between the head lamp portion 15 and end cap portion 25.

The weapon light 10 according to the invention is additionally characterized having an innovative end cap portion 25 and the inclusion of a spacer member 40 that is threadably and adjustably disposed within the end of the tubular body 20 that is coupled to the end cap portion 25.

Figure 2:
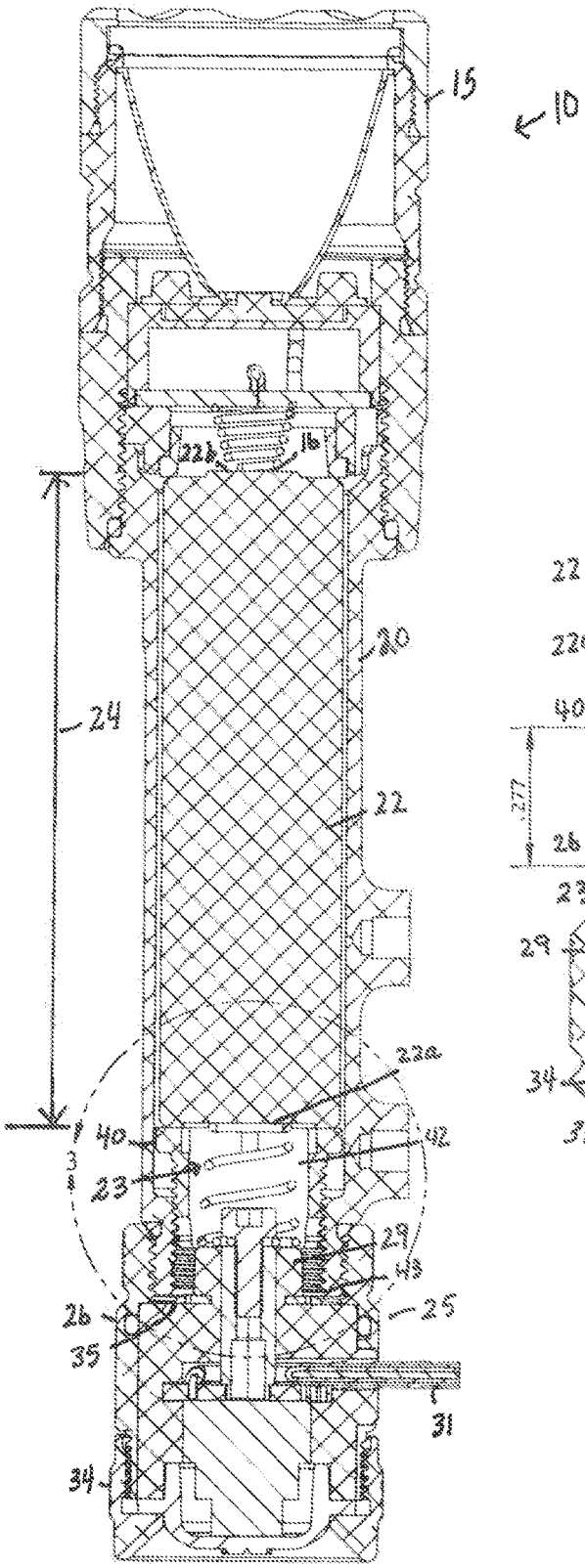
FIG. 2 is a top sectional view of the present invention.
Figure 3:
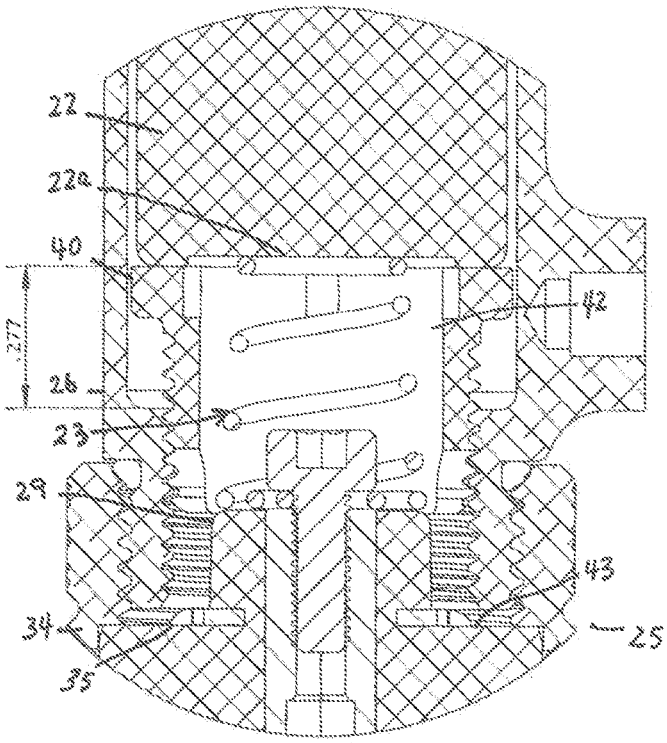
FIG. 3 is a top sectional view of the end cap portion of the present invention.

Referring to FIG. 2, a power source such as batteries 22 are received within the tubular body portion 20. As illustrated the batteries 22 are generally positioned between a battery spring 23 of the end cap portion 25 that is configured to make conductive contact with the negative end 22*a* of the battery 22, and an end portion 16 of the head lamp portion 15 that is in contact with the battery's positive end 22*b*. For purposes herein, that defined distance between battery spring 23 and end portion 10 (that defined spacing for receiving the battery(s)) is referenced in FIG. 2 as numeral 24.

End Cap Portion 25

Figure 4:
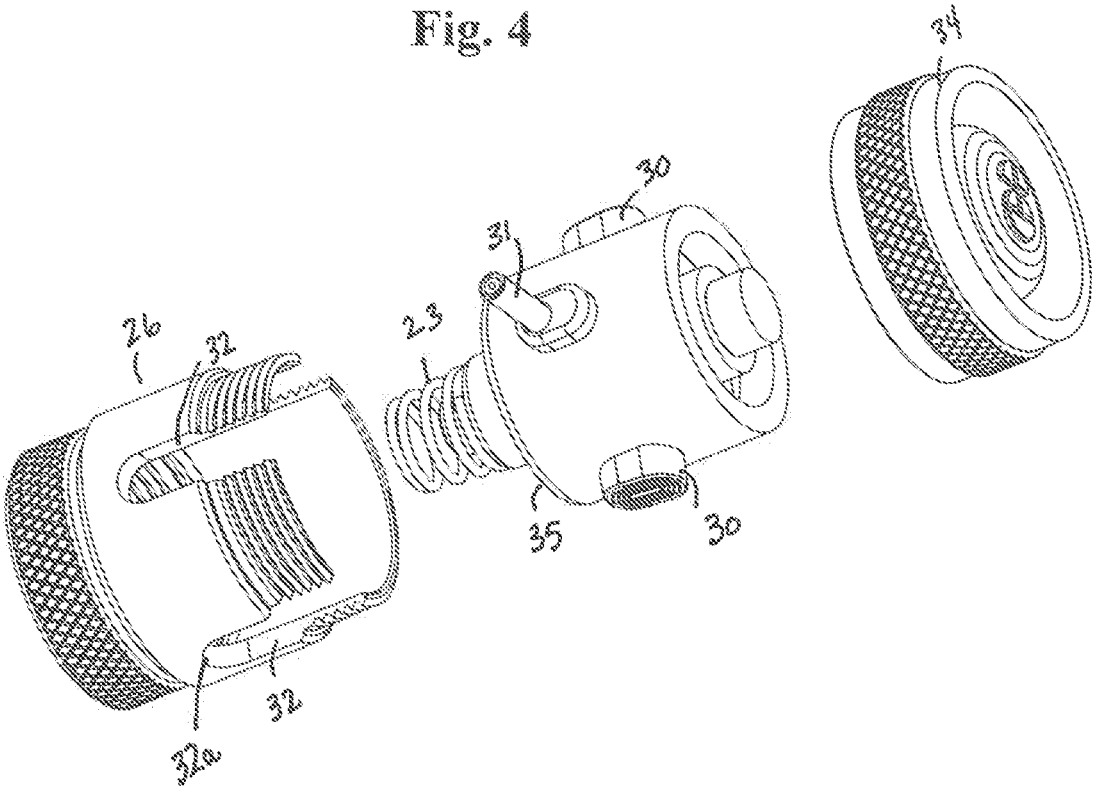
FIG. 4 is an exploded perspective view of the end cap portion.
Figure 5:
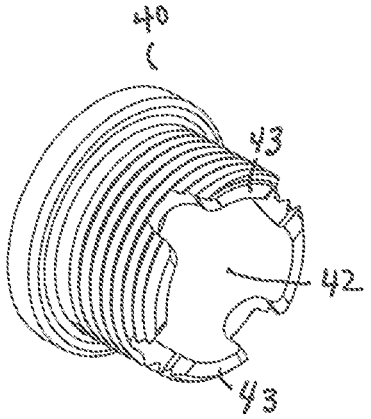
FIG. 5 is an end perspective view of the spacer member of the present invention.
Figure 6:
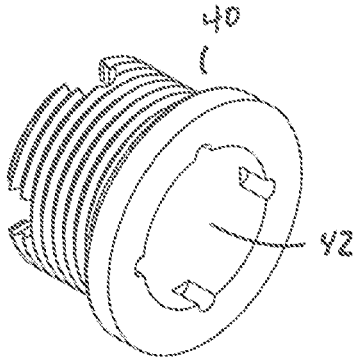
FIG. 6 is a top perspective view of the spacer member.

The end cap portion 25 is configured to transfer electric power generated from the power source 22 to a prior art tape switch (not shown). Referring to FIG. 4, end cap portion 25 includes a first member 26 that couples to the tubular body portion 20; an insert 29 that includes the battery spring 23, at least one guide member 30, and as illustrated, a wire 31 that is connected to the prior art tape switch; and an end 34 that is coupled to the first member 26.

As illustrated, the first member 26 includes at least one slot 32 for sliding receipt of the at least one guide member 30 of the insert 29. As will be understood, the battery spring 23 is selectively positioned within the tubular body 20 by positioning the at least one guide member 30 within the at least one slot 32, More particularly, when for example, the batteries 22 are shorter than the defined spacing 24 in the tubular body 20 thereby causing a gap (not shown) between battery ends and contact ends of the weapon light, the insert 29 may be urged towards an end 32*a* of the slot, thereby urging the battery spring further into the tubular body 20 and shortening the defined space 24 to fit the size batteries.

Spacer Member 40

The end of the tubular body 20 that is coupled to the end cap portion 25 as described, is further configured to threadably receive the spacer member 40. In particular, the spacer member 40 is threadably received within the tubular body 20.

The spacer member 40 defines a central aperture 42 so that in application, the battery spring 23 extends from the insert 29 and passes through the central aperture 42, into the tubular body portion 20 to make contact with the negative end 22*a* of the battery 22.

The spacer member 40 further includes an edge 43 that in application may abut an edge 35 of the insert 29. The edge 43 of the spacer member 40 may act as a stop for the positioning of the battery spring 23 within the tubular body 20. More particularly, the spacer member 40 is threadably/adjustably positioned within the tubular body 20 as described so that the insert 29 may be urged towards the end 32*a* of the slot 32 until the edge 35 contacts the stop 43, thereby again, positioning the battery spring 23 more or less inside the tubular body 20 and adjusting the defined space 24 to appropriately fit the size batteries.

Although the description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. For example, although now shown, rather than using a battery for power as illustrated and described, the power source may be some other known power means such as a supply of regulated air pressure from an external source. Thus the scope of the invention should be determined by the appended claims in the formal application and their legal equivalents, rather than by the examples given.

We claim:

1. A weapon light comprising:

a head lamp portion, a tubular body portion having a first end that is releasably coupled to the head lamp portion, and an end cap portion that is releasably coupled to a second end of the tubular body portion, opposite the head lamp portion;

a spacing within said tubular body portion that is defined between a battery spring and an end of the head lamp portion;

said end cap portion including a first member that couples to the tubular body portion;

an insert that includes the battery spring, at least one guide member, and an end that is coupled to the first member, and wherein said first member includes at least one slot for sliding receipt of the at least one guide member of the insert;

and wherein said second end of the tubular body is configured to threadably receive a spacer member that defines a central aperture such that the battery spring extends from the insert and passes through the central aperture into the tubular body portion to make contact with a power source.

2. The weapon light of claim 1, wherein said spacer member is selectively positioned within the tubular body portion so that the insert may be urged towards an end of the at least one slot thereby positioning the battery spring more or less inside the tubular body in order to adjust the spacing to fit the power source size.

3. The weapon light of claim 2, wherein said insert includes a wire that is in electrical communication with the power source and is connected to a prior art tape switch.

4. A weapon light comprising:

an end cap portion including a first member that couples to an end of a tubular body, an insert that includes a battery spring and at least one guide member, and wherein said first member includes at least one slot for sliding receipt of the at least one guide member, and wherein the end of the tubular body is configured to threadably receive a spacer member that defines a central aperture such that the battery spring extends from the insert and passes through the central aperture into the tubular body to make contact with a power source.

5. The weapon light of claim 4, wherein said spacer member is selectively positioned within the tubular body so that the insert may be urged towards an end of the slot thereby positioning the battery spring inside the tubular body in order to adjust a spacing within the tubular body.

6. The weapon light of claim 5, wherein said insert includes a wire that is in electrical communication with the power source and is connected to a prior art tape switch.

7. A weapon light comprising:

an end cap portion including a first member that couples to an end of a tubular body, an insert that includes a battery spring and at least one guide member, and wherein said first member includes at least one slot that is sized for sliding receipt of the at least one guide member, and wherein the end of the tubular body is configured to receive a spacer member that defines a central aperture.

8. The weapon light of claim 7, wherein the battery spring passes through the central aperture into the tubular body to make contact with a power source.

9. The weapon light of claim 8, wherein said spacer member is selectively positioned within the tubular body so that the insert may be urged towards an end of the slot thereby positioning the battery spring inside the tubular body in order to adjust a spacing within the tubular body.

10. The weapon light of claim 9, wherein said insert includes a wire that is hi electrical communication with the power source and is connected to a prior art tape switch.

* * * * *